US008870727B2

(12) United States Patent
Palmer

(10) Patent No.: US 8,870,727 B2
(45) Date of Patent: Oct. 28, 2014

(54) ABDOMINAL EXERCISE DEVICE

(76) Inventor: Dennis D. Palmer, Sandy, UT (US)

( * ) Notice: Subject to any disclaimer, the term of this patent is extended or adjusted under 35 U.S.C. 154(b) by 17 days.

(21) Appl. No.: 13/493,755

(22) Filed: Jun. 11, 2012

(65) Prior Publication Data

US 2012/0322636 A1 Dec. 20, 2012

Related U.S. Application Data

(60) Provisional application No. 61/495,279, filed on Jun. 9, 2011.

(51) Int. Cl.

| | |
|---|---|
| ***A63B 21/00*** | (2006.01) |
| ***A63B 26/00*** | (2006.01) |
| ***A63B 21/02*** | (2006.01) |
| ***A63B 21/055*** | (2006.01) |
| ***A63B 23/02*** | (2006.01) |
| ***A63B 21/04*** | (2006.01) |

(52) U.S. Cl.

CPC ..... *A63B 21/02* (2013.01); *A63B 21/0557* (2013.01); *A63B 23/0205* (2013.01); *A63B 21/0407* (2013.01); *A63B 21/1457* (2013.01); *A63B 21/0552* (2013.01)

USPC ..... 482/140; 482/23; 482/26; 482/30; 482/92; 482/121; 482/122; 482/123; 482/139; 128/845

(58) Field of Classification Search

USPC ..... 482/23, 26–32, 91–92, 907; D21/686–687; 128/845; 606/240; 601/24

See application file for complete search history.

(56) References Cited

U.S. PATENT DOCUMENTS

| | | | | |
|---|---|---|---|---|
| 5,207,704 | A * | 5/1993 | Shields | 606/240 |
| 5,601,519 | A * | 2/1997 | Comereski | 482/142 |
| 5,871,425 | A * | 2/1999 | Gvoich | 482/140 |
| 5,913,757 | A * | 6/1999 | Winters | 482/140 |
| 6,231,489 | B1 * | 5/2001 | McBride et al. | 482/142 |
| 6,312,366 | B1 * | 11/2001 | Prusick | 482/130 |
| D463,836 | S * | 10/2002 | Herbst | D21/686 |
| 6,569,069 | B1 * | 5/2003 | Linares | 482/148 |
| 6,634,999 | B2 * | 10/2003 | Herbst | 482/142 |
| 7,207,932 | B1 * | 4/2007 | Dean | 482/140 |
| D626,607 | S * | 11/2010 | Kim et al. | D21/671 |
| 2005/0164854 | A1 * | 7/2005 | Felberg et al. | 482/140 |
| 2006/0105894 | A1 * | 5/2006 | Denoth et al. | 482/142 |
| 2010/0197471 | A1 * | 8/2010 | Hayes et al. | 482/140 |

* cited by examiner

*Primary Examiner* — Stephen Crow
*Assistant Examiner* — Joshua Lee
(74) *Attorney, Agent, or Firm* — Thorpe North & Western LLP

(57) ABSTRACT

An abdominal exercise device is disclosed. The exercise device can include a flexible substrate having a first end and a second end. At least one of the first end and the second end can be configured to move with respect to each other. The exercise device can also include a curved portion between the first end and the second end. The curved portion can be configured to flex upon application of a force to the flexible substrate.

7 Claims, 2 Drawing Sheets

ABDOMINAL EXERCISE DEVICE

PRIORITY DATA

This application claims the benefit of U.S. Provisional Patent Application Ser. No. 61/495,279, filed on Jun. 9, 2011, which is incorporated herein by reference.

BACKGROUND

Many people engage in physical fitness activities, including young and old alike, particularly where these people are health conscious or desire to improve a physical health or condition. Some physical fitness activities include exercises to shape, tone, and/or strengthen specific groups of muscles. One particular muscle group of interest is the abdominal muscle group. Many devices and exercises have been devised to assist individuals in exercising the abdominal muscles.

Abdominal muscles can be a difficult muscle group to exercise. For example, some devices or exercises can lead to strain of back muscles or other muscles. "Sit-ups" are a popular exercise involving the muscles in the stomach and abdominal areas of the body. Many devices have been formed that aid a user in performing sit-ups in a correct form while also allowing the user to isolate certain areas and muscles in the target area. However, even with assistive devices, sit-ups can have low appeal. Furthermore, such devices are often expensive or bulky and thus undesirable to purchase or store in a home.

Even with improvements in exercises and exercise devices, as well as increased recognition of potential benefits of abdominal exercises, there yet exist various drawbacks and shortcomings. For example, bodily positions used in some exercises or with some exercise devices can be difficult to maintain even during a short duration, let alone throughout an entire exercise cycle. Maintaining a proper form can be important in achieving desired results and avoiding injury. Risk of injury is another common drawback of some exercises and devices. For example, there exists in some exercises and devices a risk that stress that could be placed on particular parts of an individual's body. If an exercise is not properly performed in a smooth curling, or rolling, action, for example, potentially harmful strain may be placed on the individual's spine, neck, or other areas.

SUMMARY

An exercise device is disclosed that can comprise a flexible substrate having a first end and a second end, at least one of the first end and the second end being configured to move with respect to each other. In addition, the exercise device can comprise a curved portion between the first end and the second end, the curved portion being configured to flex upon application of a force to the flexible substrate.

DETAILED DESCRIPTION

Reference will now be made to the examples illustrated, and specific language will be used herein to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the technology.

In describing and claiming the present invention, the following terminology will be used.

The singular forms "a," "an," and "the" include plural referents unless the context clearly dictates otherwise. Thus, for example, reference to "a tube" includes reference to one or more of such members, and reference to "directing" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Figure 1:
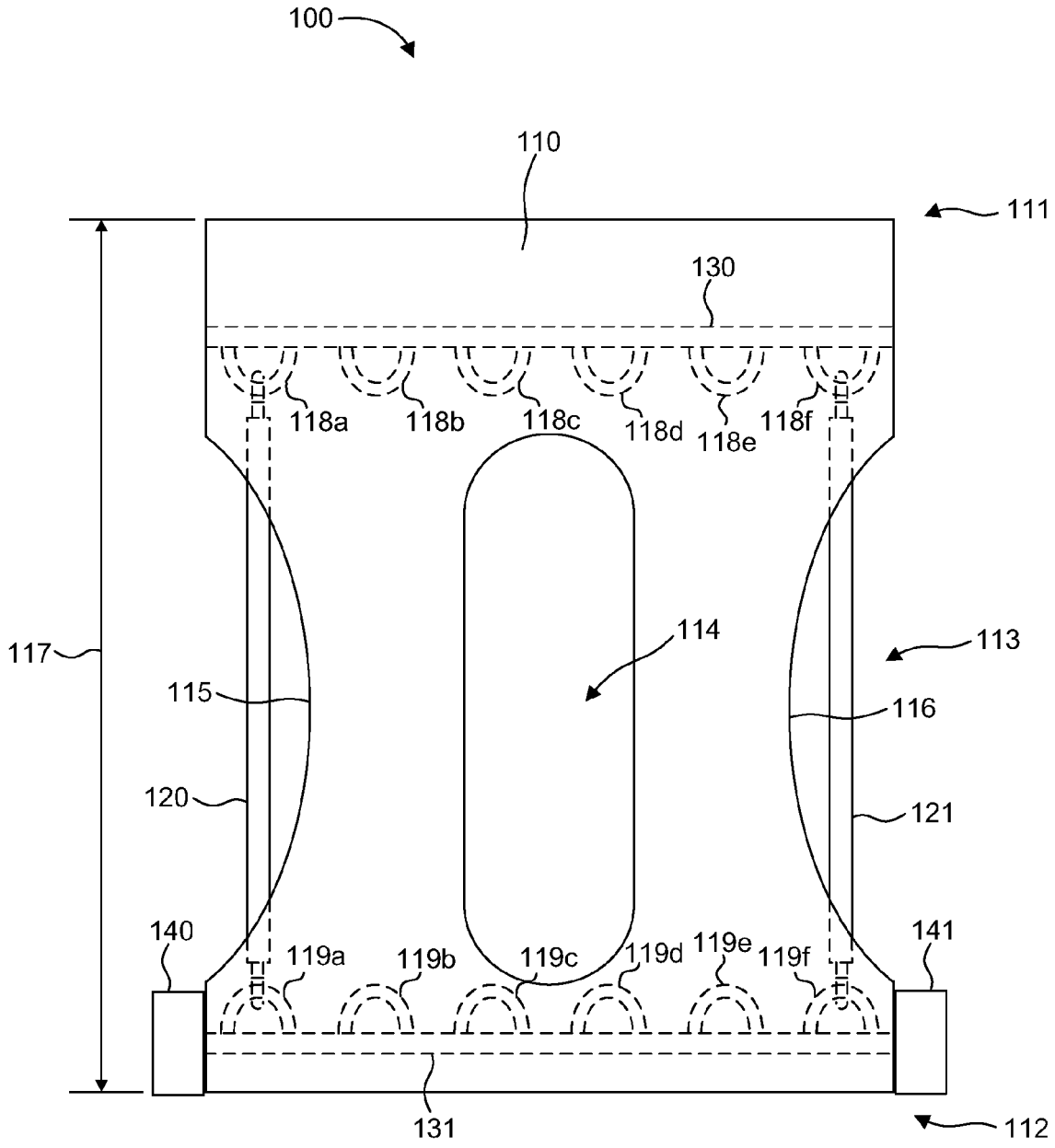
FIG. 1 is a top view of an exercise device in accordance with an example of the present technology.
Figure 2:
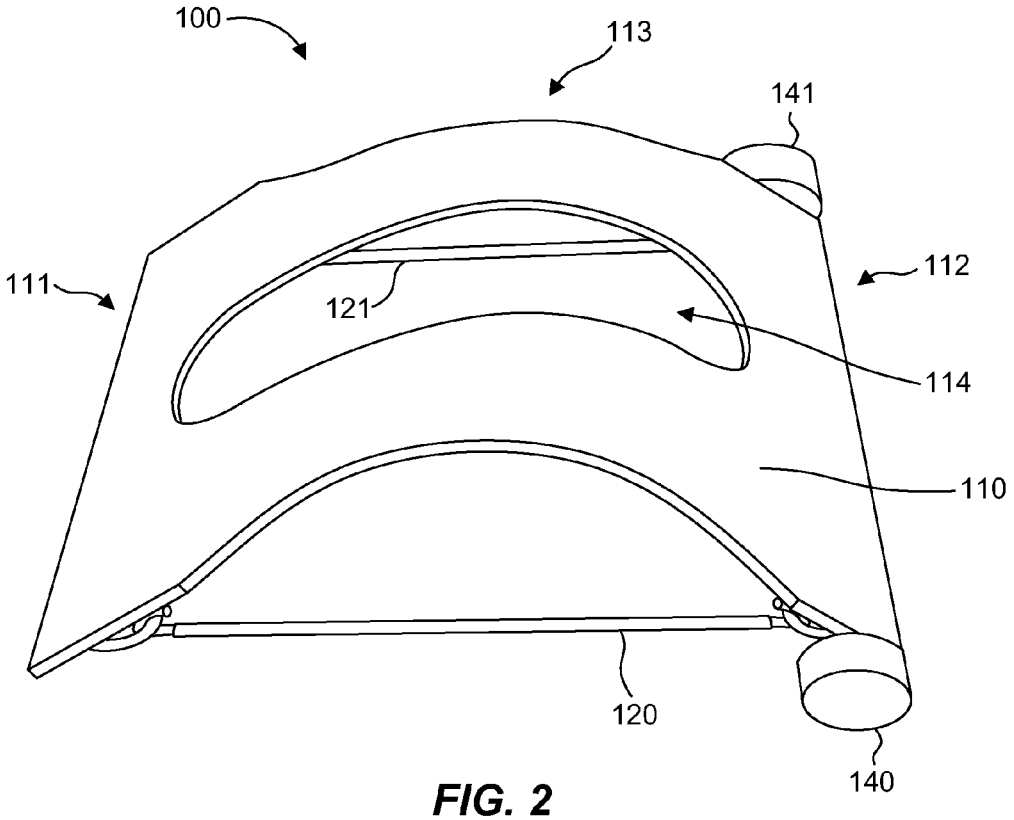
FIG. 2 is a side perspective view of the exercise device of FIG. 1.

Referring to FIGS. 1 and 2, an exercise device 100 is shown in accordance with an example of the present technology. The exercise device includes a flexible substrate 110. The flexible substrate can have a first end 111 and a second end 112. The flexible substrate can also have a curved portion 113 between the first end and the second end, the curved portion being configured to flex upon application of a force.

The substrate 110 can be made from any suitable material which is able to flex under pressure and which can be shaped with a curvature. For example, the substrate can be made from plastic, metal, wood, composites, and/or any of a variety of other materials.

In one example, voids or apertures can be formed in and/or associated with the substrate 110. For example, apertures near the ends of the substrate can be used for attaching resistance members to the substrate, as will be further described below. As another example, the substrate may include a void 114 in the curved portion 113 of the substrate. As shown in FIG. 1, this void can be a center void in the flexible substrate between sides 115, 116 of the flexible substrate and extending along a majority of a length 117 of the flexible substrate. In addition to providing potential cost savings through the use of less substrate material, the center void can provide various other benefits. For example, the void can prevent contact between the substrate and a user's spine, which contact may cause discomfort to users. As another example, the void can allow from some air to reach the user's back while exercising to cool the user's back.

Additionally as shown in FIG. 1, sides 115, 116 of the flexible substrate 110 can have an inward curvature curving toward a center of the flexible substrate at the curvature portion 113 of the flexible substrate. The curvature can similarly provide cost-savings, air flow, and so forth as with the center void described above. The curvature can also enable the device to more comfortably be used by users of different sizes.

The substrate 110 can include a cover or coating. The cover or coating may be any suitable material and may include vinyl, cotton, polyester, rubber, or other materials. For example, a material which provides a certain amount of grip between the substrate and a user's back can be desirable to minimize slippage of the back on the exercise device during use. In one aspect, edges of a long dimension of the substrate may be raised with respect to a center of the substrate so as to provide an indentation, trough, or recess for receiving a user's back to provide enhanced comfort and reduced slippage.

The substrate 110 can be shaped to have a curvature or a curved portion 113. The curvature can be formed by bending, molding, cutting, or any of a variety of other methods. The curved portion can be flexible such that application of a force or pressure upon the curvature causes the flexible substrate to flatten.

In use, the exercise device 100 can be placed on the ground or other suitable surface. A user can sit near the exercise device and lay down upon the device such that a curvature of the user's lower back is positioned substantially over the curved portion 113 of the device. The user can press downwardly on the exercise device with the user's back by flexing the user's abdominal muscles. As the user presses downwardly on the exercise device, at least one of the ends 111, 112 of the exercise device can slide away from the other end of the device and the curved portion of the device is flexed to a greater radius of curvature and comes closer to contact with the ground. By relaxing the abdominal muscles, force applied to the exercise device can be decreased and a bias of the flexible substrate can cause the flexible substrate to return from an at least partially flattened shape to the original curved shape, or at least to a position or shape similar to the original shape (depending on an amount of force still applied by the user even when not flexing the abdominal muscles).

Additionally, the exercise device 100 can include one or more elastic resistance members 120, 121. A resistance member can be configured to provide resistance against movement or flexion of the substrate upon application of a force. In one embodiment, the resistance member may be an elastic member providing elasticated resistance. The elastic member can be formed of rubber or any other material with suitable elastic properties. The elastic member may comprise a rubber or other elastomeric material sheathed by a continuous weave of braided fibers or filaments. The weave can be flexible, stretchable, and can add strength to the elastic member at a minimal cost.

In one aspect, the elastic member 120, 121 can be retained by or anchored to the substrate 110. The elastic resistance member can be removably or permanently attached to the ends 111, 112 of the exercise device, or to a location nearer to the end than to the center of the exercise device. The elastic member can be attachable to connection points associated with the substrate. With continued reference to FIG. 1, connection points 118*a*-118*f*, 119*a*-119*f* can be located at one or more locations on either end 111, 112 of the substrate, or locations in between the ends of the substrate. The substrate may have multiple connection points on either side to provide differing elasticated resistance based on where the elastic member is connected to the substrate. Also, the use of multiple connection points can facilitate multiple resistance members being attached to the substrate. For example, an elasticated resistance can be doubled by using two elastic members rather than a single elastic member.

The elastic member 120, 121 may be attachable to the connection points 118*a*-118*f*, 119*a*-119*f* by various means known or apparent to those skilled in the art, such as hook, loop, knot, clamp, clip, snap, or any other suitable other means. In the embodiments shown in the figures, the elastic member includes a hook on each end. The connection points can include loops, apertures, or other suitable devices attached to the substrate which are configured to receive the hook. In another embodiment, a connection point can comprise a slot or opening formed in the substrate. The slot or opening can be sized to allow a portion of the elastic resistance member to pass through, while preventing a thicker portion of the elastic resistance member, such as a bulb or knot, to pass through. The thicker portion of the elastic resistance member can prevent movement of the elastic resistance member through the slot, thus connecting the end of the elastic resistance member to the substrate at the connection point. In one aspect, the slot or opening can be configured to allow the elastic resistance member to "snap" into the slot or opening to prevent unwanted decoupling of the elastic resistance member from the connection point. In this manner, the elastic member can be configured to be easily and quickly attachable or detachable to connection points on the substrate.

In one aspect, the exercise device 100 can include a frame 130, 131. The frame can be attached to the substrate and can be used to attach the resistance member to the substrate for providing resistance to flexion of the substrate. The frame can be integrally formed with the substrate or can be coupled to the substrate with screws, clamps, glue, welding, or with any other suitable attachment device, which may vary depending on the material from which the substrate is made. The device can include a single frame near one of the ends 111, 112 of the substrate, or even a single frame which extends along a length of the substrate and includes a flexible portion corresponding to a curvature portion of the substrate. In another example and as shown in the figures, the frame can include a plurality of frames. For example, frames can be attached at or near the ends of the substrate. The frames can include loops, hooks, or other devices to which the resistance member(s) can be attached.

Figure 3:
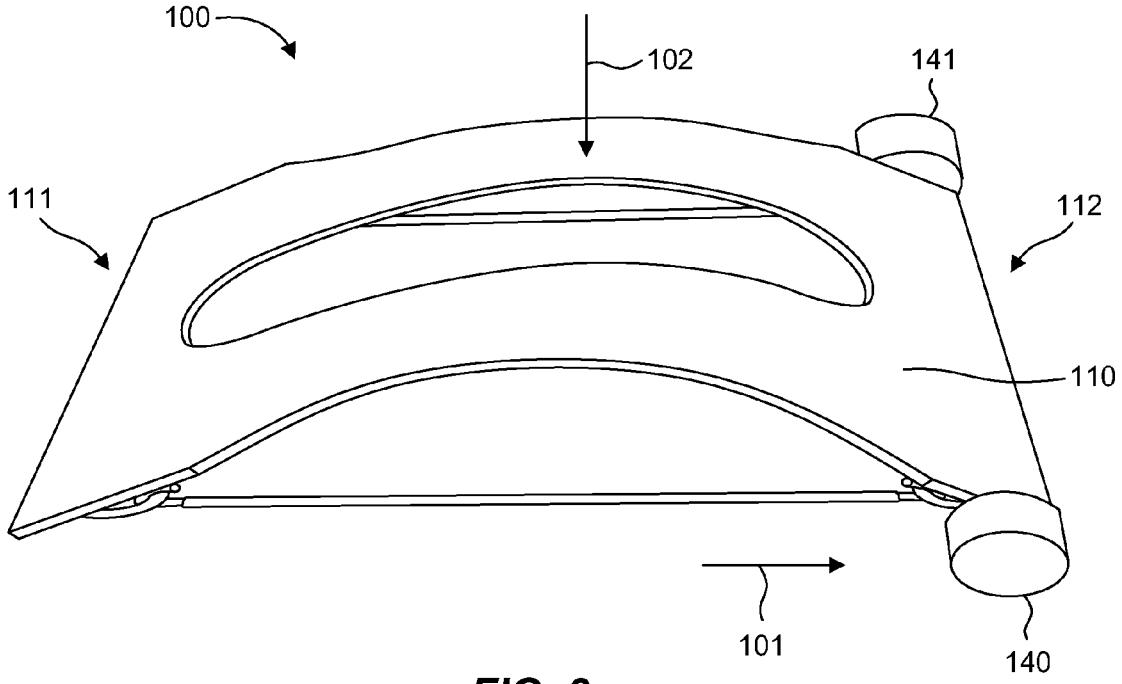
FIG. 3 is a side perspective view of the exercise device of FIG. 1 under a load.

In some embodiments, a movement device 140, 141 can be associated with at least one of the ends 111, 112 of the substrate. For example, as illustrated, a movement device can be attached to at least one of the frames 130, 131. A movement device can include a wheel, a roller, a slider, or any other suitable device to facilitate movement of an end of the substrate to which the wheels are attached. The movement device, as illustrated in FIG. 3, can enable at least one end 112 of the substrate 110 to move in direction 101 along a surface away from an opposite end 111 of the substrate as a downward force 102 is applied to the substrate. In one example, movement devices can be attached to the substrate without the use of a frame, such as by directly coupling the movement device to the substrate. Although a movement device is shown in the figures as being associated with only one end of the substrate, it should be recognized that a movement device can be associated with one or more ends of the substrate, such as opposite ends.

In accordance with examples, the type of movement device used to facilitate movement of at least one end of the substrate can be determined according to a type of surface upon which the device is to be used. For example wheels or other rolling devices may suitably enable an end of the substrate to move on a variety of surfaces. In another example, a moving end can include a slider with a rounded lip which may work well on hard or other non-slip-resistant surfaces. The rounded lip can be formed by rounding an end of the substrate, such as in a molding process, or by bending the end inwardly or outwardly. Bending the end inwardly can be advantageous over outward bending when the end includes a sharp edge or when the bent contour of the substrate would cause discomfort to a user laying on the substrate. In one aspect, the exercise device 100 can be made from a single piece of material which can be molded or shaped to include the curvature and to have one or more ends which are configured to slide on a surface as a downward force is applied to the device.

Furthermore, an opposite end of the substrate can be configured to not slide or to remain substantially stationary while the other end slides. Devices for maintaining a position of the non-sliding end can also be selected according to a surface upon which the device is to be used. For example, a hard or non-rounded edge of the non-sliding end may sufficiently maintain a position of the non-sliding end on at least some types of carpeted surfaces. As another example, the non-sliding end can include points or spikes configured to engage with a carpeted or other surface to prevent sliding. For slip-resistant surfaces, a rounded edge may also be able to sufficiently maintain a position. For non-slip resistant surfaces, and particularly for flooring surfaces such as wood, linoleum, tile, and the like, rubber feet, rubber lining, etc. can be used to provide adequate slip resistance. In one aspect, the exercise device 100 can be made from a single piece of material which can be molded or shaped to include the curvature and to have one end which is configured to slide on a surface as a downward force is applied to the device and an opposite end which is configured to remain substantially stationary while the other end slides.

In some aspects, the present technology can also include methods for exercising using the described device. For example, a method can include placing a user's lower back substantially adjacent to a curved portion of the device. The user can flex abdominal muscles to produce a downward force on the curved portion of the device, causing at least one end of the device to slide with respect to the other and causing the exercise device to at least partially flatten. The user can relax the abdominal muscles and allow the at least partially flattened exercise device to return to a more curved state. By repeating the flexing and relaxing steps, the user can exercise and strengthen the abdominal muscles.

The exercise device and associated methods of use can provide for a comfortable and enjoyable abdominal exercise with reduced risk of strain or injury as compared with some other exercises. Additionally, the device can be relatively simple in structure and can be manufactured and sold relatively inexpensively. Furthermore, the device is simple to use and can be compact in form to allow for easy storage and use even in small living spaces.

The exercise device 100 of the present disclosure includes features not present in stretching devices that are configured merely to assist a user in stretching the user's back. Such stretching devices, in contrast to the exercise device disclosed herein, have ends that are fixed relative to one another during use of the device for stretching. The exercise device 100, on the other hand, includes a flexible substrate having an end that is configured to move relative to an opposite end of the substrate during an exercise. This flexing and relative movement of the substrate ends allows the user to experience exercise movements in an abdominal exercise not available from a stretching device with fixed ends.

While the forgoing examples are illustrative of the principles of the present technology in one or more particular applications, it will be apparent to those of ordinary skill in the art that numerous modifications in form, usage and details of implementation can be made without the exercise of inventive faculty, and without departing from the principles and concepts of the technology. Accordingly, it is not intended that the technology be limited, except as by the claims set forth below.

The invention claimed is:

1. An abdominal exercise device, comprising:

a flexible substrate having a first end and a second end;

a pair of wheels being attached to the second end to enable the second end to move with respect to the first end;

an elastic resistance member removably attached to the first end and the second end; and wherein the flexible substrate comprises a curved portion between the first end and the second end, the curved portion being configured to fit a user's lower back and to flex upon application of a force to the flexible substrate.

2. The exercise device of claim 1, further comprising a first frame coupled to the first end and a second frame coupled to the second end.

3. The exercise device of claim 2, wherein the first and second frames comprise a plurality of attachment points for attaching the elastic resistance member between the first frame and the second frame.

4. The exercise device of claim 1, further comprising a plurality of voids in the flexible substrate, the plurality of voids including at least one void at the first end, at least one void at the second end, and at least one void in the curved portion.

5. The exercise device of claim 1, wherein sides of the flexible substrate comprise an inward curvature curving toward a center of the flexible substrate at the curved portion of the flexible substrate.

6. The exercise device of claim 1, further comprising a center void in the flexible substrate between sides of the flexible substrate and extending along a majority of a length of the flexible substrate.

7. The exercise device of claim 1, further comprising at least one movement device associated with at least one of the first end and the second end.

* * * * *